United States Patent [19]

Higginbotham et al.

[11] Patent Number: 4,596,656

[45] Date of Patent: Jun. 24, 1986

[54] HYDROTHERAPY WATER RETURN FITTING FOR TUBS AND SPAS

[75] Inventor: John A. Higginbotham, Maple Grove; William R. Jaworski, Minneapolis, both of Minn.

[73] Assignee: Jope Manufacturing Co. Inc., Minneapolis, Minn.

[21] Appl. No.: 620,150

[22] Filed: Jun. 13, 1984

[51] Int. Cl.[4] ..... B01B 35/02

[52] U.S. Cl. ..... 210/136; 210/169; 210/416.1; 210/436; 210/446; 4/292

[58] Field of Search ..... 210/416.1, 436, 439, 210/446, 448, 449, 451, 452, 169, 136; 4/292, 544

[56] References Cited

U.S. PATENT DOCUMENTS

| | | | |
|---|---|---|---|
| 417,127 | 12/1889 | Williams | 210/448 |
| 504,438 | 9/1893 | Messler | 210/446 |
| 936,886 | 10/1909 | Hannold | 210/448 |
| 3,072,260 | 1/1963 | Szwarguzski et al. | 210/446 |
| 3,378,858 | 4/1968 | Jacuzzi | 4/292 |
| 3,732,985 | 5/1973 | Morrell | 210/446 |
| 3,940,807 | 3/1976 | Baker et al. | 210/169 |
| 4,115,878 | 9/1978 | Johnson et al. | 4/292 |
| 4,171,209 | 10/1979 | Brown | 210/451 |
| 4,330,412 | 5/1982 | Frederick | 210/416.2 |
| 4,349,434 | 9/1982 | Jaworski | 210/416.2 |
| 4,359,790 | 11/1982 | Chalberg | 4/541 |

*Primary Examiner*—John Adee

*Attorney, Agent, or Firm*—James V. Harmon

[57] ABSTRACT

A hydrotherapy return fitting is described composed of a fitting body with a waterflow passge through it that is connected to a water circulation pump. The return fitting is suitably held within an opening bored in the wall of the tub or spa and a removable decorative liner or cover of tubular shape is provided within the interior of the fitting. It has a circular peripherally extending flange which covers portions of the fitting in the interior of the tub. A manually removable screen is provided inside the decorative liner and a handle is provided on the screen so that it can be easily grasped. A suction relief valve communicates between the atmosphere and the passage through the water return fitting to permit air to enter when the return fitting is plugged breaking the suction and allowing the object to be removed.

13 Claims, 11 Drawing Figures

HYDROTHERAPY WATER RETURN FITTING FOR TUBS AND SPAS

FIELD OF THE INVENTION

The present invention relates to hydrotherapy systems used in tubs and spas and, more particularly, to a water return fitting used in conjunction with such systems.

BACKGROUND OF THE INVENTION

In recent years there has been a substantial increase in the sale and use of hydrotherapy systems. They provide a pleasant massaging effect for the user, stimulate blood circulation and afford a sense of relaxation, comfort and luxury. While increased use has occurred in commercial applications, much of the increased use is in the home. Although prior units have been highly successful, there have been certain design shortcomings and problems associated with prior equipment. For one thing, it has been found possible for a user's hair to become trapped in the return fitting. This may result from the hair being drawn into the inlet fitting and becoming entangled around a solid object such as cross members or a brace that extends across the opening. If hair were to become caught in this manner, it could even hold a person under water. On the other hand, some form of screen is required to prevent objects from being drawn into the water return fitting.

Another problem is the undesirable accumulation of water in the circulation pump that results from an inability of the pump to drain completely when the tub is emptied. This can cause corrosion or promote the growth of algae during prolonged periods of nonuse.

Another problem is the requirement for enabling the return fitting to match other components such as faucets, hydrotherapy jet fittings, etc. The matchup is usually made either at the time of the initial installation or at some later time after a visible part of the fitting has become damaged and requires replacement. In the past, this has often required the partial disassembly of the fitting and the replacement of one or more parts. While liners have been proposed for use in therapy components, they have sometimes been difficult to remove and replace and may require the use of tools which make it more difficult, particularly for a homeowner, to install a replacement cap. In view of these deficiencies of the prior art, it is a general objective of the invention to provide an improved water return fitting for use in a hydrotherapy system for a tub or spa in which there is provided an effective means for preventing hair entrapment, for allowing water to drain from circulation pumps and a decorative cover or liner that can be easily and quickly replaced in many cases without the use of tools.

It is also sometimes possible for a part of the user's body to seal the inlet opening of the water return fitting causing discomfort or injury.

These and other more detailed and specific objects will be disclosed in the course of the following specification with reference to the accompanying drawings which illustrate the invention by way of example.

THE FIGURES

FIG. 5 is a side elevational view of the inlet screen showing it relative to FIG. 4 in a position ready for insertion.

SUMMARY OF THE INVENTION

The invention provides a hydrotherapy fitting for tubs and spas, the main component of which is a fitting body having a central water passage that extends through it with an inlet and an outlet at the respective ends of the passage. A suction connection is provided at the inlet end of the passage for fastening the inlet to the suction line of a water circulation pump. A retaining means such as a retaining ring or collar is provided in proximity with the inlet end of the passage for fastening the fitting body into a round opening in the wall of the tub or spa. Inside the fitting body is provided a removable screen having an outer edge frictionally engaged in the passage and being manually removable at all times through the inlet opening so that it can be easily pulled out by hand. The inward movement of the screen is limited by the provision of a stop which prevents it from being inserted too far. The screen is engaged in the passage solely by the frictional engagement at its outer edge. The central passage is free from cross members, projections or the like upon which body hair might be caught. As a result, any object that becomes caught in the screen can be removed by withdrawing the screen through the inlet end of the passage. In a preferred form of the invention, a handle is provided on the screen extending centrally toward the inside of the tub to facilitate manual removal. The handle is preferably open at the center with screen elements provided across the open center portion.

Further, in accordance with the preferred form of the invention, a removable and replaceable liner or cover is provided that completely encloses and hides the inner aspect of the return fitting. This liner may be colored silver, bronze, gold or chromium, etc., to match other plumbing items and in one preferred form of the invention, the screen is engaged within the internal bore of the liner.

In accordance with another preferred feature of the invention, an air inlet is provided within the return fitting for breaking the suction in case an object or a part of the body becomes caught against and seals the inlet opening.

The invention includes other features and advantages which will be described by way of example by reference to the drawings.

DETAILED DESCRIPTION OF THE PREFERRED EMBODIMENTS

Figure 1:
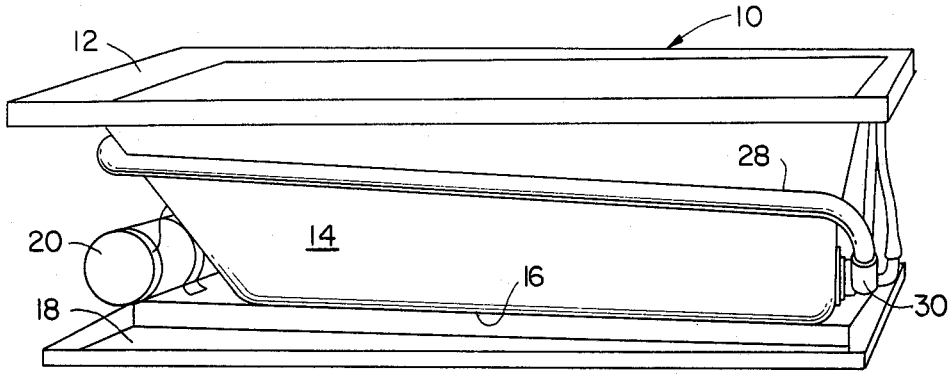
FIG. 1 is a perspective view of a hydrotherapy tub in which a return fitting in accordance with the present invention is installed.
Figure 2:
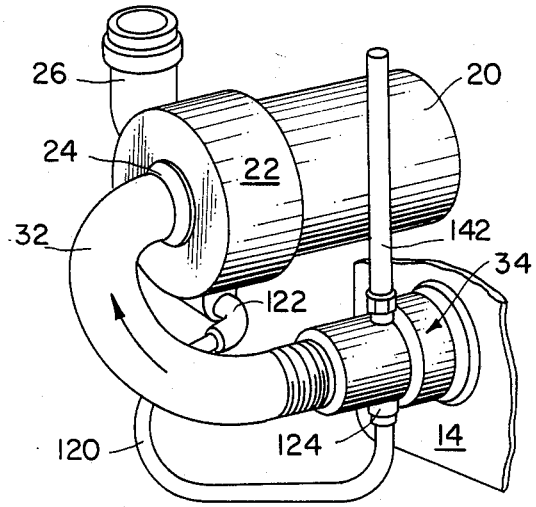
FIG. 2 is a perspective view of the installed water return fitting as seen from the outside of the tub showing its connection to the water circulation pump.
Figure 3:
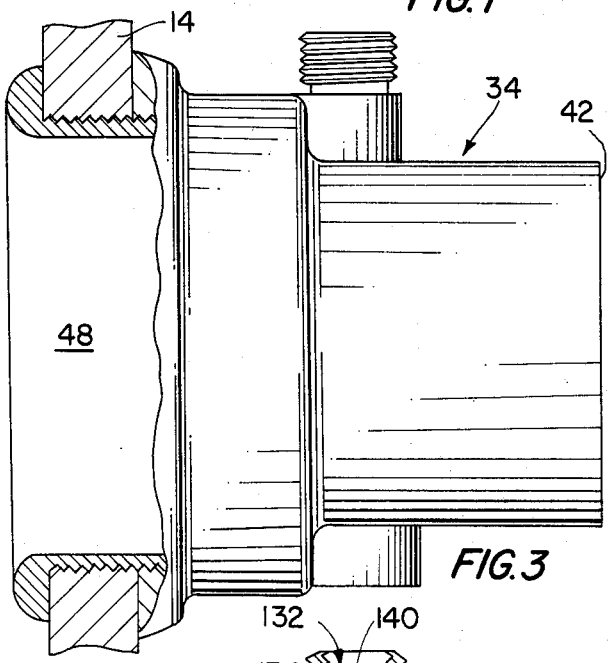
FIG. 3 is a side elevation of the water return fitting shown partly in section.

Shown in FIG. 1 is a tub or spa 10 having an upper edge 12 and an inclined side wall 14 and bottom wall 16 resting on a base 18 that is employed for shipment, storage and installation. Mounted upon the base 18 is an electric pump motor 20 to which is secured a water circulation pump 22 of the centrifugal type having an inlet 24 and an outlet 26 connected to a pressure line 28 that feeds water to a hydrotherapy jet 30 through which the water is mixed with air and expelled under pressure to the interior of the tub 10. Connected to the inlet 24 of the pump 22 is a suction line 32 that is coupled to a water return fitting indicated generally by the numeral 34. The water return fitting 34 is formed from several pieces, the main one of which is a fitting body 36 having an internal water passage 38 with an inlet end 40 and an outlet end 42. The outlet end 42 is provided with a connection means such as threads 44 for securing the fitting to the suction line 32 which communicates with the inlet end of the pump 22. The inlet end of the fitting 24 communicates with the interior of the tub 10 and is provided with a connecting means comprising threads 46 for securing the fitting body to a retaining collar 48. As can be seen, the retaining collar 48 is threaded externally to fit within the threaded bore at the inlet end 40 of the drain fitting body 36. As best seen in FIG. 3, the retaining collar 48 is provided with a circumferentially extending, outwardly projecting flange 50 having a flat outward surface 52 adapted to seal against the inner surface of the tub wall 14 when the retaining collar is tightened down within the threads 46 of the drain fitting body 36. A similar flange 58 with a flat outer surface 60 is provided on the drain fitting body in position to cooperate with the surface 52 for sealing the drain fitting body into an opening in the tub wall 14, preferably with the assistance of a suitable adhesive. Within the return fitting is provided a removable screen 62. The screen 62 can be placed directly inside the water return fitting as already described but is preferably located within an optional liner or cover 64 which will now be described.

The liner or decorative cover 64 will be best understood with particular reference to FIGS. 4 and 9–11. As shown, the liner includes a tubular body section 66 that may be of a decorative shape internally, for example, the interior may have a hexagonal cross-sectional shape. At least the inside surface is provided with a slight draft proceeding toward its inner edge 68 to reduce turbulence and assist in mold separation when the liner is manufactured. At the inner edge of the liner 64 is a laterally extending circular flange 70 which curves outwardly, i.e., back toward the body of the liner 64 at its outer edge 72. This creates an annular recess 74 of just sufficient size to accommodate the exposed surface 50*a* of flange 50.

Provided on the outer surface of the side wall 66 of the liner 64 are two pairs of diametrically opposed longitudinally extending bayonet slots 76 separated by shoulder portions 78 having ramp surfaces 80 on their inner edges. The flanged retaining collar 48 is provided with a pair of cooperating bayonet lugs 82 which, when the liner 64 is installed, slide longitudinally through one of the slots 76 and then, upon twisting the liner manually, the lugs 82 are forced up the ramp surfaces 80, thereby tightening the liner in place but allowing it to be easily and quickly removed by hand if necessary for replacement at a later time. The decorative cover or liner 64 can be provided in any one of a number of different colors such as gold, chrome, satin brass, antique brass, polished brass, pewter, etc. It can be used to match plumbing fixtures or components of the hydrotherapy jet 30. It is also contemplated that the liner 64 can be used as a replaceable decorative cover for the jet nozzle 30 itself. Thus, the liner 64 will function equally well as a decorative internal cover for both the water return fitting 34 and the jet nozzle 30. This will enable the manufacturer to supply jet nozzles and water return fittings of any suitable metal such as brass, bronze or plated steel, or of a plastic resin such as ABS or PBC as well as other suitable resins which will be apparent to those skilled in the art.

Figure 4:
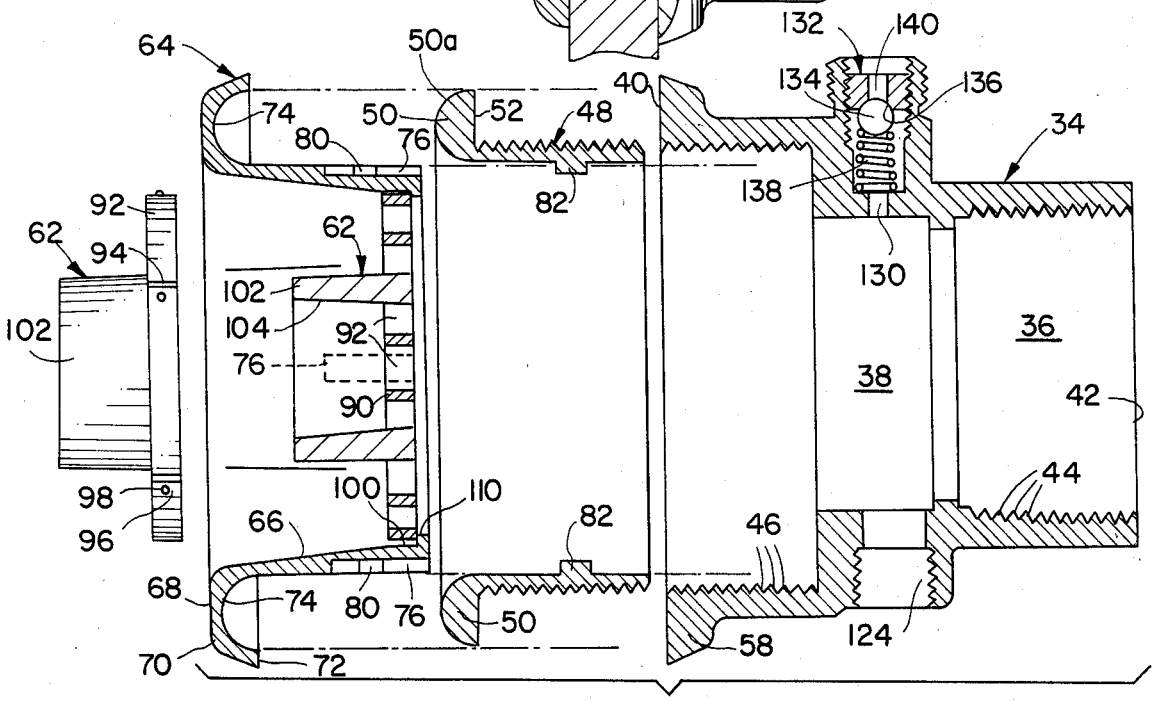
FIG. 4 is a vertical sectional view of the water return fitting with the parts exploded for clarity.
Figure 6:
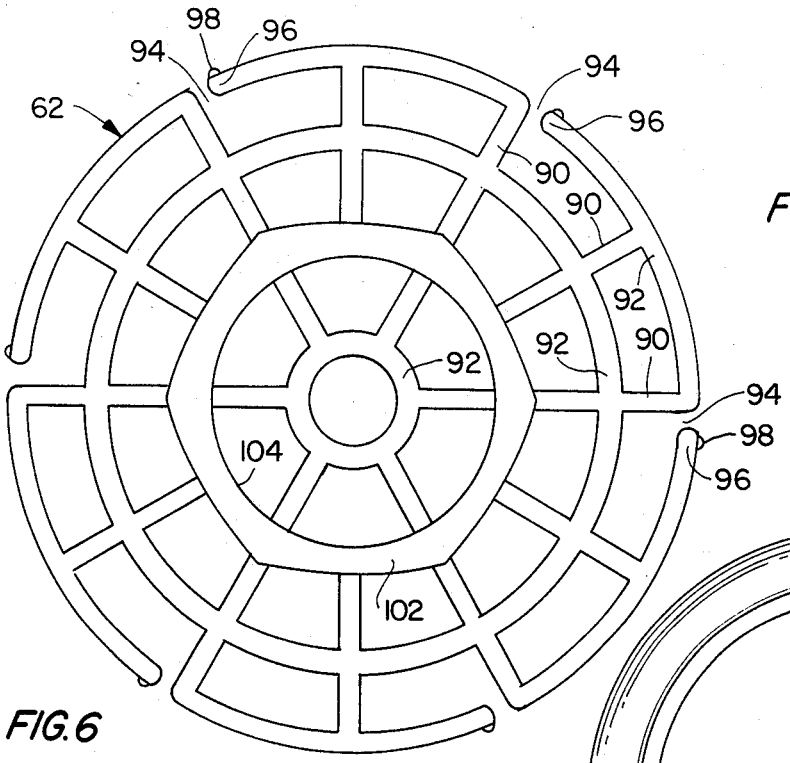
FIG. 6 is a front view of the inlet screen.
Figure 7:
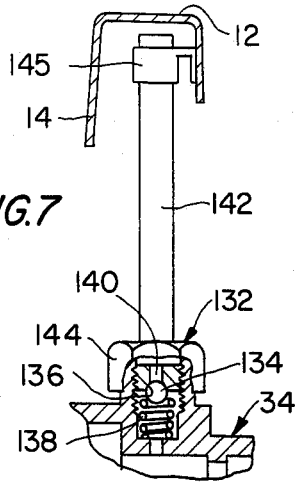
FIG. 7 is a view of the air inlet pipe associated with the water return fitting.
Figure 8:
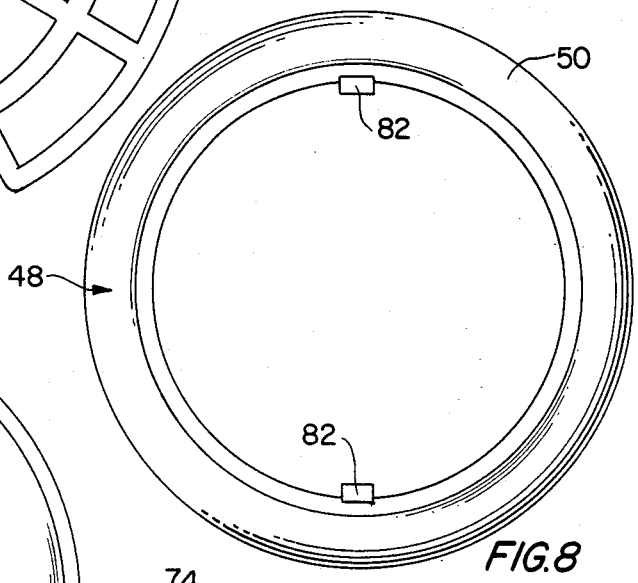
FIG. 8 is an end view of the retaining collar as seen on line 8—8 of FIG. 4.
Figure 9:
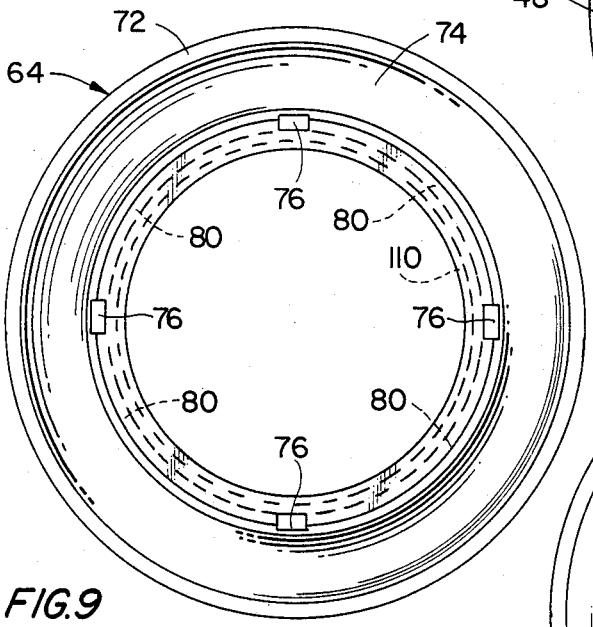
FIG. 9 is an end view of the liner as it appears taken on line 9—9 of FIG. 4.
Figure 10:
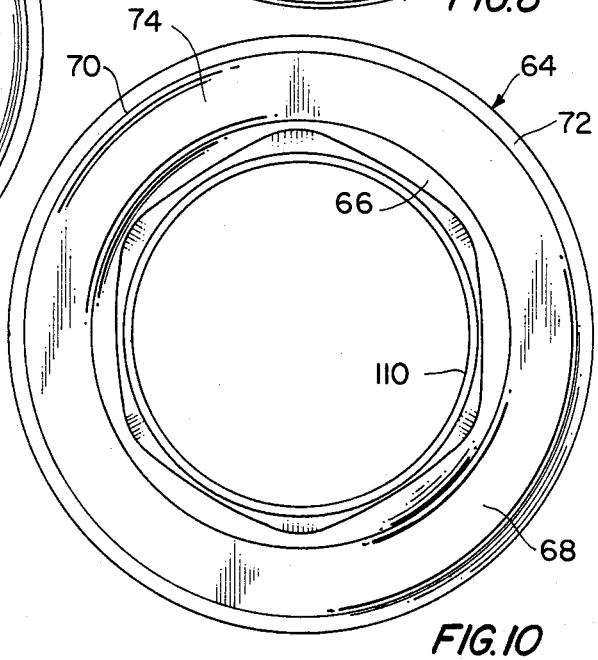
FIG. 10 is an end view of the liner as seen from the left end of FIG. 4.
Figure 11:
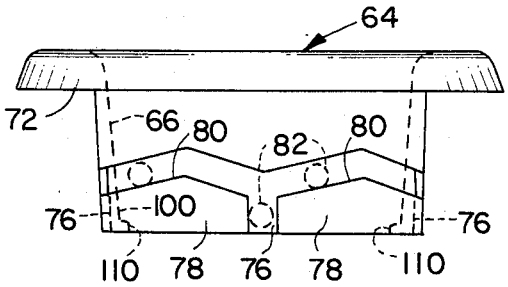
FIG. 11 is a side view of the liner on a slightly reduced scale.

The removable screen 62 will now be described with reference particularly to FIGS. 4–6. As can be seen, the screen consists of a latticework composed of radiating spokes 90 which are integral with circumferentially extending rings 92. Some portions of the outermost ring 92 are broken at circumferentially spaced locations 94 to provide resilient terminal portions 96 that have small outwardly facing projections 98 at their free ends which can be made to frictionally engage or snap into centrally facing recess 100 in the interior of the liner 64 adjacent its outer edge. It can be seen that the screen 62 is provided with a centrally extending tubular or circular handle 102. The handle 102 has an open center 104 which is covered by portions of the screen 90, 92. In this way, the handle 102 does not block the screen but instead, by virtue of its open center 104, provides greater screen area allowing more water to flow without obstruction through the screen. In addition, the ring or tubular shape of the handle 102 provides a unit of the proper size to grasp easily with the hand, helps to keep solid objects from being pressed up against the screen and helps to strengthen the screen 62. The size of the screen 62 should be adjusted so that it slides easily into the liner 64 and remains in place during use by virtue of the frictional engagement between its outer edge and the inner surface of the liner 64. If desired, however, the recess 100 can be appropriately formed to accommodate the projections 98 so that they snap into place for additional security of mounting. In either case, however, the screen is constructed so that it can be easily removed by pulling it out manually.

It should be noted that the entire interior of the drain fitting body 34 as well as the related components including the retaining collar 48 and the liner 64 are free from cross members or the like upon which body hair might become caught. As a result, when any object is caught on the screen, it can be removed along with the screen by withdrawing the screen through the inlet end of the waterflow passage through the water return fitting. As shown in FIG. 4, the liner is provided with a low centrally extending circular stop 110 which limits the outward movement of the screen 62 when the screen is inserted. If the return fitting 34 is designed for use without a liner 64, the screen 62 would be properly sized to fit directly into the water return fitting itself and a stop means similar to the stop 110 would be provided in the interior of the water return fitting to limit the insertion of the screen into the water return fitting.

In one preferred form of the invention, a drain pipe 120 is connected via fitting 122 to the lower portion of the volute of the pump 22. At the other end the pipe 120 is connected to a drain port 124 in the body 36 of the water return fitting 34. In this way, any accumulated water remaining in the pump volute will reliably drain from the tub 14 when the water is removed via the drain port 124.

In approximately the center of the drain fitting body 36 is a port 130 communicating with an anti-hair entrapment suction release check valve 132 comprising a ball 134 pressed against the seat 136 by spring 138 and communicating through an air inlet port 140 with an air inlet tube 142. The air inlet tube 142 is held in place by threaded fitting 144 and at its upper end by means of a bracket 145 secured to the wall of the tub 14. During operation, if the water inlet becomes plugged with hair or a portion of a person's body, the resulting increase in suction within the return fitting will cause the check valve to immediately open and the air introduced through port 130 will cause cavitation in the pump breaking the suction and allowing whatever is obstructing the inlet of the return fitting to be removed. The ball will then move back into its seat and operation can continue normally. The seat 136 is preferably movable toward or away from the ball to increase or decrease the spring tension of spring 138. This can be accomplished by constructing the seat 136 as a threaded cylinder screw threaded into the interior of the check valve so that it can be screwed toward or away from the spring 138, thereby either increasing or decreasing its pressure against the ball 134. The spring 138 is adjusted for each particular system. Reducing the spring tension will reduce the suction required to unseat the ball.

From the above description, it can be seen that the manually removable liner 64 will serve as a decorative interior cover which will permit the water return fitting to match other plumbing fixtures. In addition, it can be easily removed and replaced by hand if replacement is required. The screen 62 can be easily removed by hand. If it were to become partially or completely plugged with hair, the strands of hair passing through it would have nothing to become entangled on and therefore could be easily removed. The handle 102 is easy to grasp and the open center 104 provides additional screen area to facilitate the flow of water through it. It can also be seen that the suction release check valve 132 will immediately break the suction if an object partially or completely seals the inlet end of the passage 38 through the water return fitting, in this way allowing the obstructing object to be easily removed.

Many variations of the invention will be apparent to those skilled in the art within the scope of the appended claims once the principles described herein are understood.

What is claimed is:

1. A Hydrotherapy water return outlet fitting for tubs and spas enclosing a body of water comprising, a fitting body having a central water passage extending therethrough with a water inlet opening communicating with the body of water and a water outlet at the respective ends of the passage, suction connection means at the outlet end of the passage for fastening the outlet to a suction line of a water circulation pump, a retaining means in proximity with the inlet end of the passage for fastening the fitting body into an opening into the wall of said pump or spas, a manually removable decorative liner engaged within the interior of the inlet end of said passage, a removable screen telescopically engaged within the liner by being slidably insertable through the inlet opening and being visible through said inlet opening, said screen having an outer edge frictionally engaged in the liner and being manually removable at all times through the inlet open such that it can be readily withdrawn by hand, stop means limiting the inward movement of the screen in the liner, said screen being engaged in the liner solely at its outer edge and the central passage being free from cross members or the like upon which body hair might become entangled whereby any object caught in the screen can be removed along with the screen by withdrawing the screen through the inlet end of the liner.

2. The combination of claim 1 wherein the screen is provided with snap fit connecting means between itself and the interior of the liner.

3. The combination of claim 1 wherein the screen is provided with circumferentially extending resilient fingers having yieldable free ends and projections are provided on the free ends of the fingers, said lines return fitting is provided with an inwardly facing recess to accommodate the projections whereby the projections in the screen will snap into the recess in the lines.

4. The combination of claim 3 wherein the recess is facing interiorly within the liner and the screen being thereby adapted to snap fit into the interior of the liner.

5. The hydrotherapy return fitting of claim 1 wherein, said decorative liner comprising a tubular body section and an annular outwardly extending flange portion at an inward end, said flange being adapted to cover an exposed portion of the water return fitting.

6. The combination of claim 5 wherein a bayonet connection is provided between the liner and the water return fitting.

7. The combination of claim 1 wherein an air inlet duct communicating at one end with the surrounding air and a check valve communicates between the air inlet duct and said passage through said hydrotherapy return fitting to break the suction resulting from an object becoming plugged in the inlet of said passage to allow the object to be easily removed.

8. The combination of claim 1 wherein a flanged retaining collar is screw threaded into the inlet in the fitting body to secure the fitting body in an opening within a wall of said tub, said removable decorative liner has a tubular body section and an inner peripherally extending circular flange adapted to cover the retaining collar is releasably mounted within the interior of the retaining collar, said retaining collar includes a peripheral flange portion seated against an inside surface of said tub and said liner flange covers the flange of the retaining collar.

9. The combination of claim 1 wherein a bayonet connection is provided between the interior of the retaining collar and the exterior of the decorative liner for securing the liner in place within the retaining collar.

10. A hydrotherapy return fitting for spas and tubs comprising, a fitting body having a central water passage extending therethrough with a water inlet and a water outlet at the respective ends thereof, suction connection means at the outlet end of the passage for fastening the outlet to a suction line of a water circulation pump, retaining means in proximity with the inlet end of the passage for fastening the fitting body into an an air inlet duct opening into the atmosphere, a suction relief check valve connected to the air inlet duct and communicating through said hydrotherapy return fitting body with the passage therein, said check valve having a movable valve member yieldably biased onto a seat to seal the check valve whereby partial or complete obstruction of the inlet end of the passage will unseat the valve allowing air from the atmosphere to enter the passage causing cavitation of the pump thereby breaking the suction and allowing the object obstructing the inlet to be removed.

11. The combination of claim 10 wherein the check valve comprises a ball check valve which said ball is yieldably biased against said seat and means is provided for adjusting the pressure of the yieldable biasing means.

12. A hydrotherapy fitting for tubs and spas enclosing a body of water comprising, a fitting body having a central water passage extending therethrough with a water inlet opening at one end communicating with the body of water and a water outlet at the other end of the passage, suction connection means at the outlet end of the passage for fastening the outlet to a suction line of a water circulation pump, a retaining means in proximity with the inlet end of the passage for fastening the fitting body into an opening in a wall of said tub or spa, a removable screen telescopically engaged within the fitting body and being slidably insertable through the inlet opening and being visible through said inlet opening, said screen having an outer edge frictionally engaged in the fitting body and being manually removable at all times through the inlet opening such that said screen can be readily withdrawn by hand through the inlet opening, stop means limiting the inward movement of the screen in the fitting body, said screen being engaged in the fitting body solely at its outer edge and the central passage being free from cross members or the like upon which body hair might become entangled whereby any object caught in the screen can be removed along with the screen by withdrawing the screen through the inlet opening of the fitting body, said screen having an inwardly projecting handle extending toward the interior of said body of water, said handle being constructed and arranged to be grasped by hand through the inlet opening to facilitate the removal of the screen through the inlet opening.

13. The fitting of claim 12 wherein said screen has an inwardly projecting handle thereon and said handle comprises a hollow tube communicating through said screen between the interior of the tub and the passage in the fitting body to facilitate the flow of water through said handle, thence through said screen and into said passage.

* * * * *